US005333387A

United States Patent [19]

Ankenbruck et al.

[11] Patent Number: 5,333,387

[45] Date of Patent: Aug. 2, 1994

[54] COLOR DRAWING TOY

[75] Inventors: James B. Ankenbruck, Bryan, Ohio; Jose V. Antolin, Addison, Ill.; Horst D. Herbstler, Bolingbrook, Ill.; Bruce D. Lund, Chicago, Ill.; Anne K. Vahcic, Chicago, Ill.; Lowell T. Wilson, Bryan, Ohio

[73] Assignee: The Ohio Art Company, Bryan, Ohio

[21] Appl. No.: 93,964

[22] Filed: Jul. 21, 1993

[51] Int. Cl.[5] ..... B43L 13/00

[52] U.S. Cl. ..... 33/18.1; 33/1 M; 346/139 R

[58] Field of Search ..... 33/18.1, 1 M, 23.03; 346/139 R, 143

[56] References Cited

U.S. PATENT DOCUMENTS

| | | | |
|---|---|---|---|
| 2,484,298 | 10/1949 | Krahulec | 33/18.1 |
| 2,556,546 | 9/1951 | Barnes, Jr. et al. | 346/139 |
| 3,055,113 | 9/1962 | Grandjean | 33/18.1 |
| 3,360,799 | 12/1967 | Polster | 346/29 |
| 3,665,610 | 5/1972 | Schlau et al. | 33/18 R |
| 3,760,505 | 9/1973 | Clark | 33/18.1 |
| 4,135,303 | 1/1979 | Gresset | 33/18 R |
| 4,369,579 | 1/1983 | Mizoule | 33/1 M |
| 4,512,079 | 4/1985 | LeBlond | 33/1 M |
| 4,550,503 | 11/1985 | Klawitter | 33/18 R |
| 4,736,211 | 4/1988 | Sieber et al. | 33/18.1 |
| 4,801,266 | 1/1989 | Kinberg | 33/18.1 |
| 4,856,197 | 8/1989 | Auer et al. | 33/18.1 |
| 4,949,466 | 8/1990 | Auer et al. | 33/1 M |

FOREIGN PATENT DOCUMENTS

| | | | |
|---|---|---|---|
| 566687 | 11/1958 | Canada | 33/18.1 |
| 2-45197 | 2/1990 | Japan | 33/18.1 |

*Primary Examiner*—William A. Cuchlinski, Jr.
*Assistant Examiner*—G. Bradley Bennett
*Attorney, Agent, or Firm*—Hugh Adam Kirk

[57] ABSTRACT

Disclosure concerns a portable drawing toy comprising an openable rectangular box having manual rotatable knobs in the two lower opposite corners, which knobs move by strings and pulleys a horizontal and a vertical bar orthogonally with respect to each other. At the intersection of these bars is a socket for one of a plurality of different colored marking pens. A cover for the box comprises a framed window with flanges for holding a translucent paper on the underside of the window so that when the cover is closed the marker pen contacts the paper and rotation of the knobs causes the pen to draw lines on the paper, which lines can be viewed through the window. The translucent paper can be changed for retaining the drawing made thereon, and a magazine for different colored pens is provided in the base of the box.

6 Claims, 6 Drawing Sheets

COLOR DRAWING TOY

BACKGROUND OF THE INVENTION

The prior art comprises manually-operated orthogonally movable stylus in a sealed box for etching a pattern on a window as disclosed in applicants' assignee's U.S. Pat. No. 3,055,113 to Grandjean issued Sep. 25, 1962 and Clark U.S. Pat. No. 3,760,505 issued Sep. 25, 1973. The adaptation of such drawing toys to produce a permanent replaceable record is disclosed in Barnes, Jr. et al U.S. Pat. No. 2,566,546 issued Sep. 4, 1951. These prior art devices have the disadvantage of containing a powder which is sealed in a box and/or being very complicated.

SUMMARY OF THE INVENTION

This invention involves adapting the sketching device of Clark mentioned above for making repeated permanent multi-colored records of designs. The base is substantially rectangular open-top box which contains the manual knobs and the strings and pulleys and orthogonally movable crossbars intersecting in a marking pen socket. The open top of the box has a hinged cover which contains a transparent window behind which window is a replaceable translucent sheet of paper. Mounted in the base frame is a magazine for a plurality of pens with caps, which pens may have their caps removed and can be selectively placed in the socket which replaced the stylus in the above mentioned patents. When the proper pen is inserted in this socket, and a translucent sheet of paper is placed in the holder therefor underneath the glass window and the cover is closed, manipulation of the knobs on the box will produce a pattern on the translucent paper. This pattern can be retained and another marker pen and/or another sheet may be inserted for another or further drawing.

OBJECTS AND ADVANTAGES

It is an object of this invention to produce a simple, efficient, effective and economic drawing toy for making multi-color permanent or record-retaining designs.

Another object is to employ an orthogonal manually-operable drawing mechanism for producing a permanent record design in any one or more of a plurality of colors.

BRIEF DESCRIPTION OF THE DRAWINGS

The above mentioned and other features, objects and advantages and the manner of attaining them are described more specifically below in reference to an embodiment of this invention shown in the accompanying drawings wherein.

DETAILED DESCRIPTION OF THE PREFERRED EMBODIMENT

A. Housing

Figure 1:
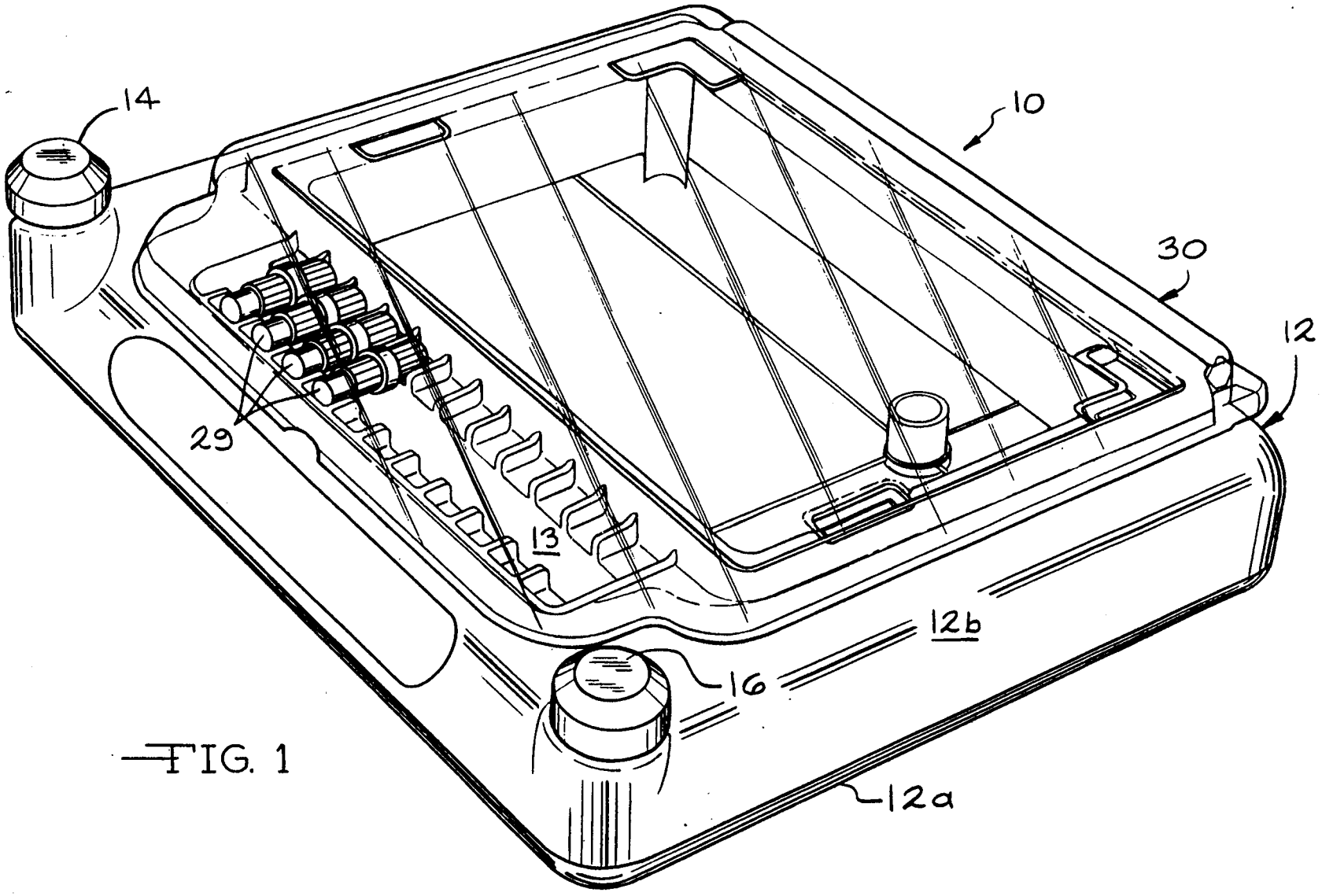
FIG. 1 is a perspective view of a preferred embodiment of the color drawing toy of this invention.
Figure 2:
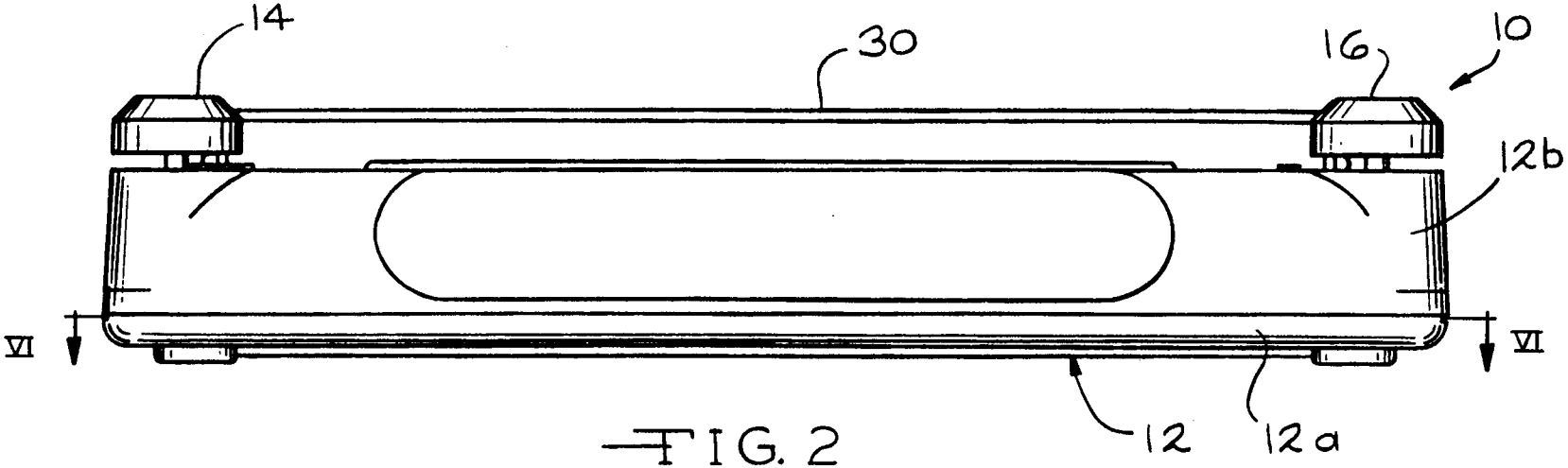
FIG. 2 is a side elevation of the toy shown in FIG. 1.
Figure 3:
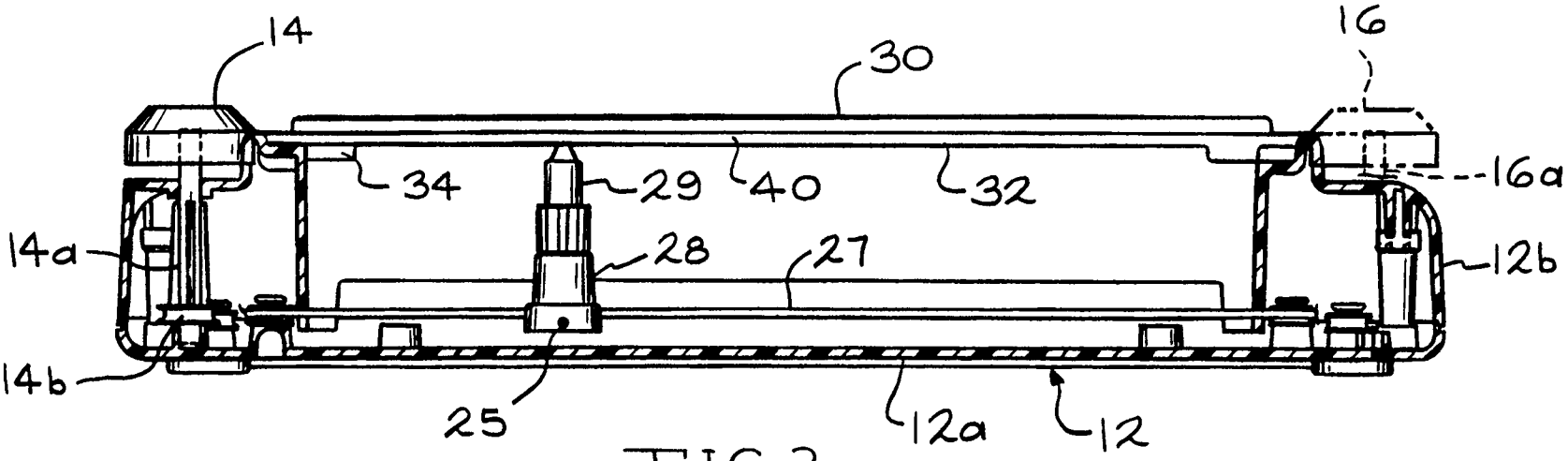
FIG. 3 is a vertical section taken along stepped line III—III in FIG. 4 showing some of the pulleys and strings for operating the orthogonal rods which move the penholder against the inside of the cover for marking on the translucent sheet held against the window of the cover.

Referring first to FIGS. 1 and 2, there is shown an assembled drawing toy 10 of this invention comprising a rectangular open top box or base 12 having vertical and horizontal manual control knobs 16 and 14, respectively, and a framed window hinged cover 30. The base 12 may be composed of two separate plastic members, viz. the bottom 12a of the container 12, and the frame sides **12*b* of the container 12 with the top pocket 13 for storing a plurality of capped marker pens 29**.

B. Drive Mechanism

Referring now to FIGS. 3 through 6, there are shown the axles **14*a* and 16*a* for the manual operating knobs 14 and 16 which are connected to pulleys 14*b* and 16*b* journalled in the base section 12*a***.

Figure 6:
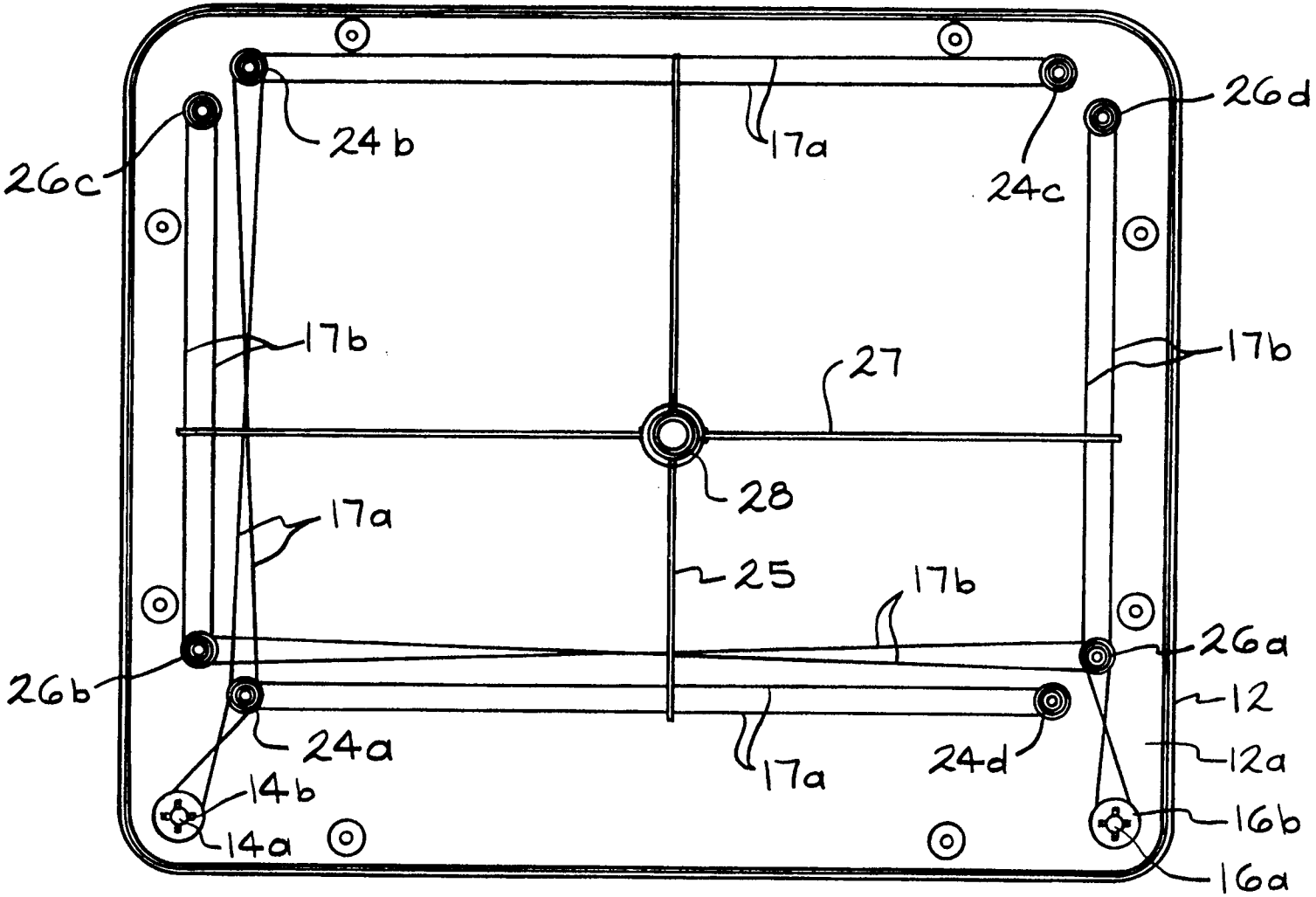
FIG. 6 is a sectional view taken along line VI—VI in FIG. 2.

Referring now more specifically to FIG. 6 there is shown the string **17*a* wrapped around corner pulleys 24*a*, 24*b*, 24*c* and 24*d*, which string 17*a* is driven by the pulley 14*b* to move the vertical rod 25 horizontally, the ends of which rod 25 are connected to the parallel moving reaches of the string 17*a* between pulleys 24*a* and 24*d* and 24*b* and 24*c*, respectively. Similarly, the corner pulleys 26*a*, 26*b*, 26*c* and 26*d* are driven by string 17*b* connected to the pulley 16*b* for moving the horizontal bar 27 connected to parallel vertical reaches between the pulleys 26*b* and 26*c* and 26*a* and 26*d*, respectively, for moving the horizontal bar 27 vertically. Where the bars 25 and 27 intersect, there is a marker socket 28, diametrically through the base of which socket these bars 25 and 27 pass and slide. Into the other open upper end of the socket 28 are placed selected marker pens 29 which normally have caps 29*a*. Thus, as the horizontal manual driving knob 14 is rotated, it moves the vertical rod 25 horizontally to correspondingly move the marker socket 28 and its marker 29. Correspondingly the rotation of knob 16 moves the horizontal rod 27 vertically to move the socket 28 and its marker 29. Also if both knobs 14 and 16 are rotated simultaneously, the marker 29 then moves in an angular and/or curved direction depending upon the relative speeds the knobs 14 and 16** are rotated.

Figure 4:
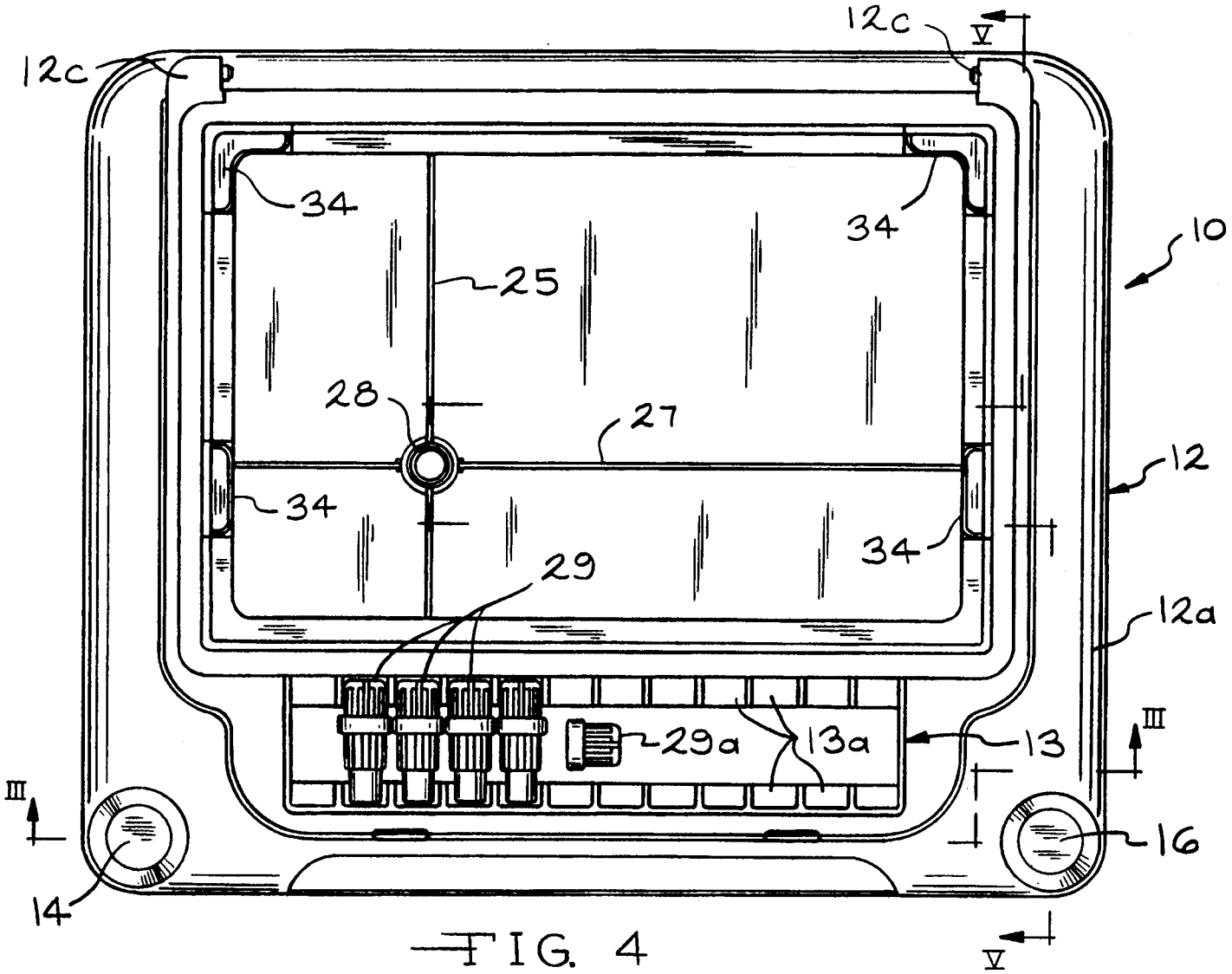
FIG. 4 is a plan view of the device shown in FIG. 1 with the cover removed, showing the orthogonal rods for moving the marker socket and the magazine for the different colored pens.

As shown in FIG. 4, there is provided a magazine 13 with corresponding notches **13*a* for a plurality of the markers 29 with their caps 29*a*. When the caps 29*a* are removed from the felt-tip or marker end of the markers 29, the caps may be put on the other end of the markers before the markers are fitted into the socket 28. The mechanism is so constructed that the natural resiliency of the rods 25 and 27 and their driving strings 17*a* and 17*b* urge the markers into contact with the underside of the cover or lid 30 to insure marking on the replaceable translucent sheet 40 on the underside of the window cover 30**.

C. Cover

Figure 5:
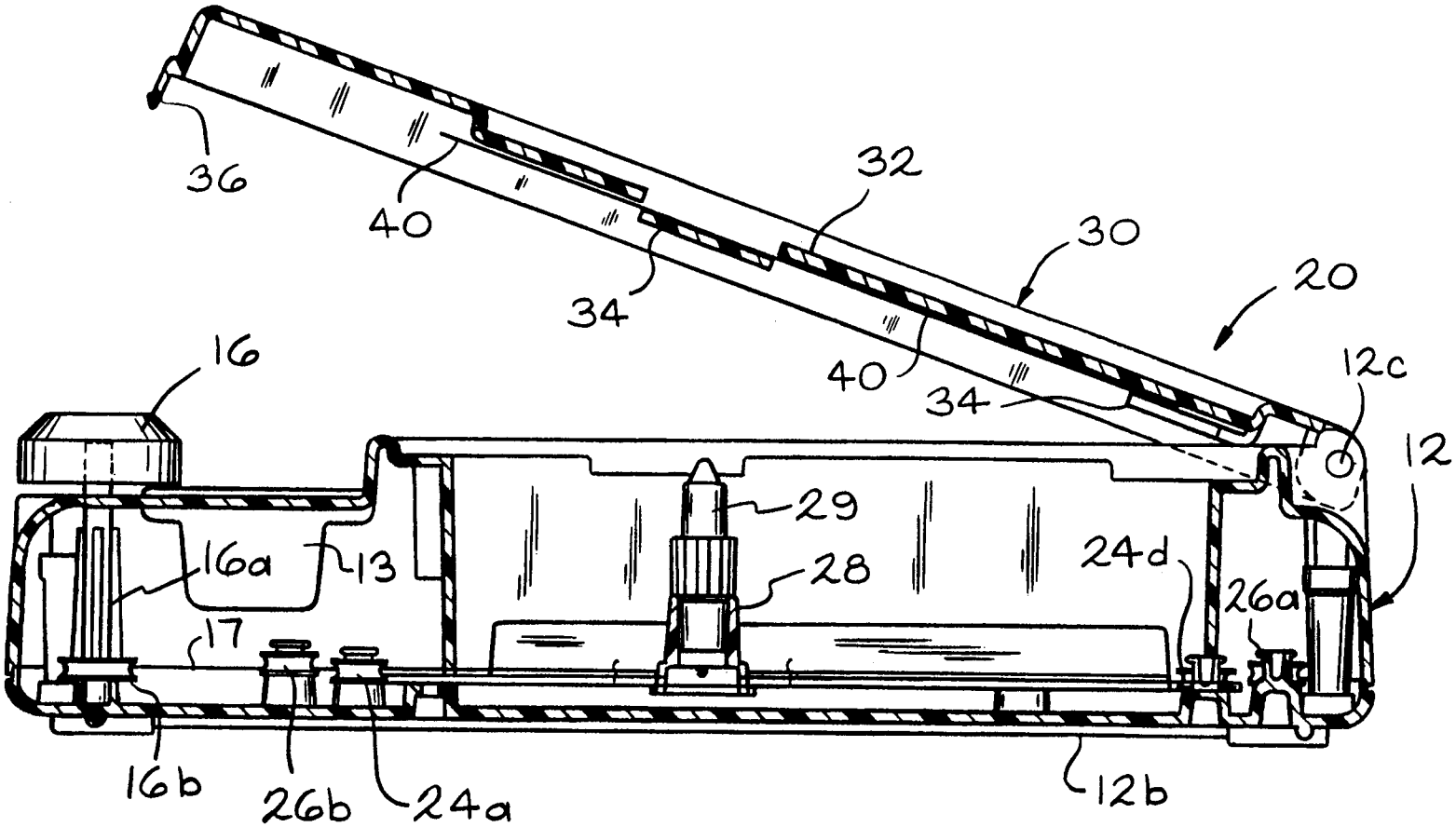
FIG. 5 is a sectional view taken along line V—V in FIG. 4 with the cover installed and partly open.
Figure 7:
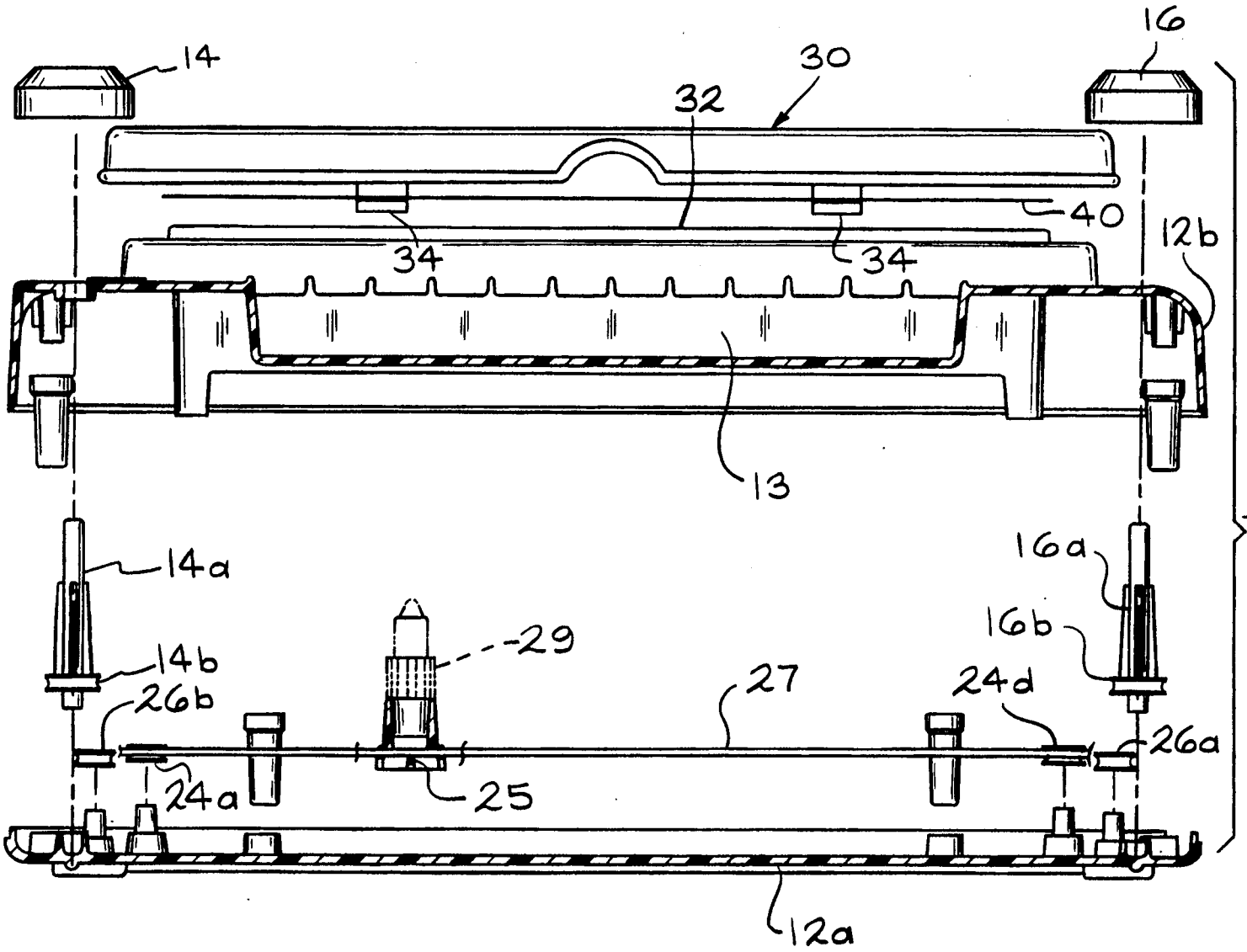
FIG. 7 is an expanded vertical sectional view of the parts making up the box and the cover as shown in section similar to FIG. 3.

Referring now to FIGS. 4, 5 and 7, the cover 30 is hinged to the trunnions **12*c* at the opposite upper corners of the base 12 from the manual knobs 14 and 16. This cover 30 comprises a frame with a central transparent window 32 and adjacent its edges, flanges 34 on three adjacent sides thereof for holding a sheet 40 of translucent paper upon which the markers 29** make their marks.

Thus once the translucent paper 40 is inserted under the cover 30 and window 32 and into flanges 34, and the lid or cover 30 is closed or snapped shut by the detent 36 shown at the outer open edge of the cover 30 in FIG. 5, the marker pen 29 is then held against the paper 40 for marking a dot on the paper. Thus when the manual knobs 14 and 16 are rotated, this marker draws a line on the paper 40. When the drawing is completed the lid or cover 30 is lifted, the sheet 40 may be removed to retain the drawing and another translucent sheet 40 may be placed against the transparent window 32. Also a different colored marker 29 may be placed in the socket 28 or one can change in marker to another color for drawing on the same sheet 40.

Although the present embodiment of this device is shown made out of plastic, it is within the scope of this invention that other materials suitable for the operation of this simplified drawing toy can be substituted therefor without departing from the scope of this invention.

While there is described above the principles of this invention the connection with a specific apparatus, it is to be clearly understood that the description is made only by way of example and not as a limitation to the scope of this invention.

We claim:

1. A sketching device comprising:

a) an open top base box, b) means within said box for moving a socket orthogonally around the open top of said box, c) a marker replaceable in said socket, d) a cover for said top of said box, e) a transparent window in said cover, f) a translucent replaceable sheet on the inside of said window, and g) means under said cover adjacent said window for holding said translucent sheet adjacent the inside surface of said window whereby said marker contacts the underside of said translucent sheet when said cover closes said open top of said box.

2. A device according to claim 1 wherein the resilience of said means for moving the socket is sufficient to urge the marker against the translucent sheet when the cover is closed.

3. A device according to claim 1 wherein the cover is hinged to said box.

4. A device according to claim 1 wherein said means for removably holding said sheet against said window comprises flanges along at least two opposite sides of said window inside said cover.

5. A device according to claim 1 including storage means for extra markers.

6. A device according to claim 5 wherein said storage means is located in said base.

* * * * *